United States Patent [19]

Agata

[11] Patent Number: 4,545,695

[45] Date of Patent: Oct. 8, 1985

[54] HORIZONTAL PRINTING TYPE PRINTER

[75] Inventor: Kazuhiro Agata, Osaka, Japan

[73] Assignee: NEC Home Electronics, Ltd., Osaka, Japan

[21] Appl. No.: 695,829

[22] Filed: Jan. 28, 1985

[30] Foreign Application Priority Data

Jan. 31, 1984 [JP] Japan ..... 59-15781

[51] Int. Cl.[4] ..... B41J 3/28; B41J 19/00

[52] U.S. Cl. ..... 400/320; 400/616; 400/31

[58] Field of Search ..... 346/29; 33/18 R, 18 B; 400/29, 31, 320, 320.1, 616, 616.1, 616.2

[56] References Cited

U.S. PATENT DOCUMENTS

| | | | |
|---|---|---|---|
| 2,651,400 | 9/1953 | Young et al. | 400/29 |
| 3,380,065 | 4/1968 | Alpert et al. | 346/29 |
| 3,554,347 | 1/1971 | Perkins | 400/320 |
| 3,987,884 | 10/1976 | Buxton | 400/616.1 X |

FOREIGN PATENT DOCUMENTS

| | | | |
|---|---|---|---|
| 2437886 | 2/1975 | Fed. Rep. of Germany | 400/320 |

*Primary Examiner*—Clifford D. Crowder

*Attorney, Agent, or Firm*—Cushman, Darby & Cushman

[57] ABSTRACT

A horizontal printing type printer including a head feeding motor serving as a shaft feeding motor; a feeding shaft coupled to the motor so that it is rotatable in both directions, the shaft being arranged in a vertical direction perpendicular to the printing line direction; two sheet feeding tractors mounted on the shaft, two one-way clutches provided on the tractors, respectively, the one-way clutches being engaged with the shaft to rotate together with the latter in the sheet feeding direction to feed the printing sheet; and a printing head movably supported on the shaft and a guide rod parallel with the latter, the printing head being moved backwards and forwards in the vertical direction of rotation of the shaft.

2 Claims, 8 Drawing Figures

HORIZONTAL PRINTING TYPE PRINTER

BACKGROUND OF THE INVENTION

The present invention relates to printers and more particularly to horizontal printing type printers.

In conventional impact printers, sequential pages are provided perpendicular to the printing line. Therefore, when a plurality of pages are sequentially printed by the printer, the pages align vertically as shown in FIG. 1. Accordingly, when it is required to bind the pages, the pages, after being folded, are bound together by using the upper marginal portion as shown in FIG. 2. Unfortunately, the thus bound pages are difficult to read. More specifically, when the thus bound pages are held by the hand, it is rather difficult or troublesome to read them because the pages are aligned in opposite directions to one another. Furthermore, it is exceedingly troublesome to handle the pages because the pages must be alternately turned over to be read.

In some word processor printers, two pages are, respectively, printed on the right and left halves of a printing sheet and the sheets thus printed are bound into a book. This method may be acceptable where uniform cut printing sheets are used, but it is disadvantageous in the following situation.

Where continuous forms or a printing sheet roll is used, the forms or sheet roll must be cut by using perforations or with a cutter. The cutting operation must be performed with a high degree of accuracy. The cut edges of each printing sheet must be properly aligned since the sheets appear in the book which is formed by binding the cut printing sheets together.

Accordingly, an object of this invention is to eliminate the above-described difficulties accompanying a conventional printer.

More specifically, an object of the invention is to provide a horizontal printing type printer in which the printing output results can be read with ease, the pages printed out can be readily bound, and the thus bound pages can be read with ease.

SUMMARY OF THE INVENTION

The foregoing objects and other objects of the invention have been achieved by providing a horizontal printing type printer which includes a head feeding motor which also serves as a sheet feeding motor; a feeding shaft coupled to the head feeding motor so that the feeding shaft is reversibly rotatable in the forward direction and in the reverse direction, the feeding shaft being arranged in a vertical direction perpendicular to the printing line direction and having a cam groove in the cylindrical outer surface thereof; a pair of sheet feeding tractors rotatably mounted on the feeding shaft with a predetermined distance therebetween; a pair of one-way clutches provided on the sheet feeding tractors, respectively, the one-way clutches being engaged with the feeding shaft to rotate together with the feeding shaft in the sheet feeding direction when a printing sheet is fed; and a printing head vertically, reciprocally and movably supported between the feeding shaft and a guide rod provided in parallel with the feeding shaft, the printing head being moved backwards and forward in the vertical direction separately according to the direction of rotation of the feeding shaft.

The nature, principle and utility of the invention will become more apparent from the following detailed description when read in conjunction with the accompanying drawings.

DETAILED DESCRIPTION OF THE INVENTION

Figure 1:
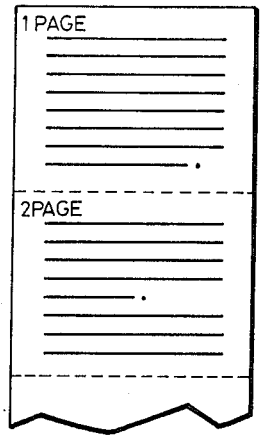
FIG. 1 is an explanatory diagram showing the printing output results of a conventional printer.
Figure 2:
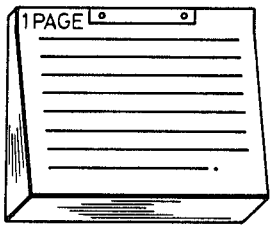
FIG. 2 is a perspective view showing a book which is formed by binding a plurality of pages printed by the conventional printer.
Figure 3:
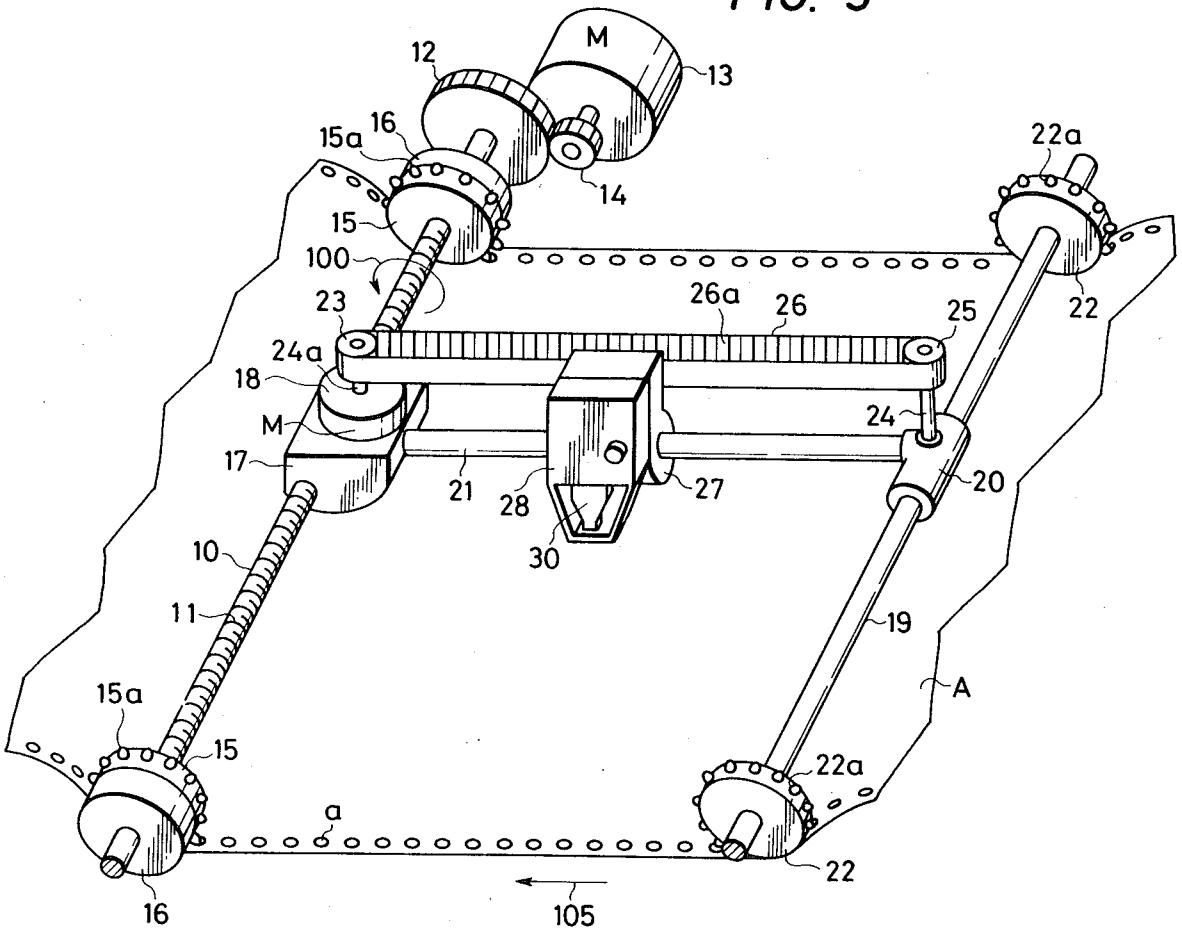
FIG. 3 is a perspective view showing one example of a horizontal printing type printer according to the present invention.

An exemplary horizontal printing type printer in accordance with the present invention is shown in FIG. 3. The horizontal printing type printer has a feeding sheet 10 extended along the top-to-bottom direction (hereinafter referred to as "a vertical direction") of a printing sheet A which is perpendicular to the sheet feeding direction (hereinafter referred to as "a horizontal direction"). The shaft 10 has a cam groove 11 cut in its cylindrical outer surface, and a gear 12 at one end. The gear 12 is engaged with a gear 14 mounted on the output shaft of a vertical feeding motor 13. Therefore, as the motor 13 is driven, the feeding shaft 10 is rotated in a forward or reverse direction.

A pair of tractors 15 and 15 for feeding a printing sheet A are mounted on the feeding one-way clutch 16 with a predetermined distance therebetween. As shown, tractors 15 have pins 15*a* engaging guide holes a in sheet A to move sheet A in the direction of arrow 105.

A pair of one-way clutches 16 are also mounted on the shaft 10 in such a manner that they are on the outer sides of the tractors 15, respectively.

When the feeding shaft 10 is rotated by the motor 13 in the forward direction as indicated by the arrow 100 to change the printing line (as described later), the clutches 16 are disengaged from the tractors 15, so that the tractors 15 are free from the rotation of the shaft 10, i.e., the tractors 15 are held stopped in a non-rotating mode. When the shaft 10 is rotated in the reverse direction opposite to the direction of the arrow 100 to feed the printing sheet A, the clutches 16 are engaged with the tractors 15, so that the tractors 15 are rotated with the feeding shaft 10.

A guide nut 17 is threadably mounted on the feeding shaft 10 so that it is reciprocated in the vertical direction as feed shaft 10 rotates. Guide nut 17 threadably engages cam groove 11 on feeding shaft 10. A horizontal feed motor 18 is provided on the guide nut 17.

A guide rod 19 is provided on the side of the insertion of a printing sheet A in such a manner that it is in parallel with the feeding shaft 10 with a predetermined distance therebetween. A guide block 20 is vertically and slidably mounted on the guide rod 19. The guide block 20 is connected through a guide shaft 21 to the aforementioned guide nut 17, so that the guide nut 17 and the guide block 20 are moved vertically in a synchronous manner. A pair of guide tractors 22 and 22 are rotatably mounted on the guide shaft 21 at both ends so as to press down the loaded printing sheet A so that the sheet may not be slackened or raised, and to guide it in the sheet feeding direction. As shown, guide tractors 22 have pins 22*a* engaging guide holes a in sheet A.

A pulley 23 is mounted on the output shaft of the horizontal feed motor 18. A pulley 25 is mounted on the guide block shaft 24 which is extended from the guide block 20. Shaft 24 is parallel to shaft 24*a*. An endless belt 26 is laid over the pulleys 23 and 25. The surface of endless belt 26 contacting pulleys 23 and 25 may have ribs 26*a*.

A head carriage 27 is slidably mounted on the guide shaft 21. The head carriage 27 is connected to the belt 26, so that it is moved through the belt 26 by the horizontal feed motor 18 in the horizontal direction along the guide shaft 21. An ink ribbon cassette 28 incorporating an ink ribbon (not shown) is detachably mounted on the head carriage 27. A printing head 30 is provided integral with the ink ribbon cassette 28, so that it receives ink from the ink ribbon, to print on the printing sheet A.

Instead of the above-described tractors 15 or guide tractors 22, friction rollers made of rubber may be employed.

The printing operation of the above printer will now be described.

First, a printing sheet A is inserted from the right side as shown in FIG. 3. In this case, the printing head 30 is set at its home position (HP) in the upper left portion of FIG. 4 by the vertical feed motor 13 and the horizontal feed motor 18. Printing head 30 is now ready for printing. In this condition, when the horizontal feed motor 18 turns in the forward direction (counterclockwise in FIG. 4), the head carriage 27 is moved through the belt 26 in the printing line direction as indicated by the arrow 101 in FIG. 4, while the printing head 30 prints characters, and the like on the printing sheet A in the printing line direction.

When the head carriage 27 reaches the end position in its horizontal movement, i.e., the printing head 30 prints one line, the horizontal feed motor 18 is stopped. Then, the vertical feed motor 13 is turned in the forward direction as required. As a result, the clutches 16 are disengaged from the tractors 15, which tractors 15 are thus held stopped. While the feeding shaft 10 is rotated, the guide nut 17 together with the guide block are moved for a predetermined distance corresponding to one printing line. Thus, the line changing operation has been achieved as shown in FIG. 5.

Figure 5:
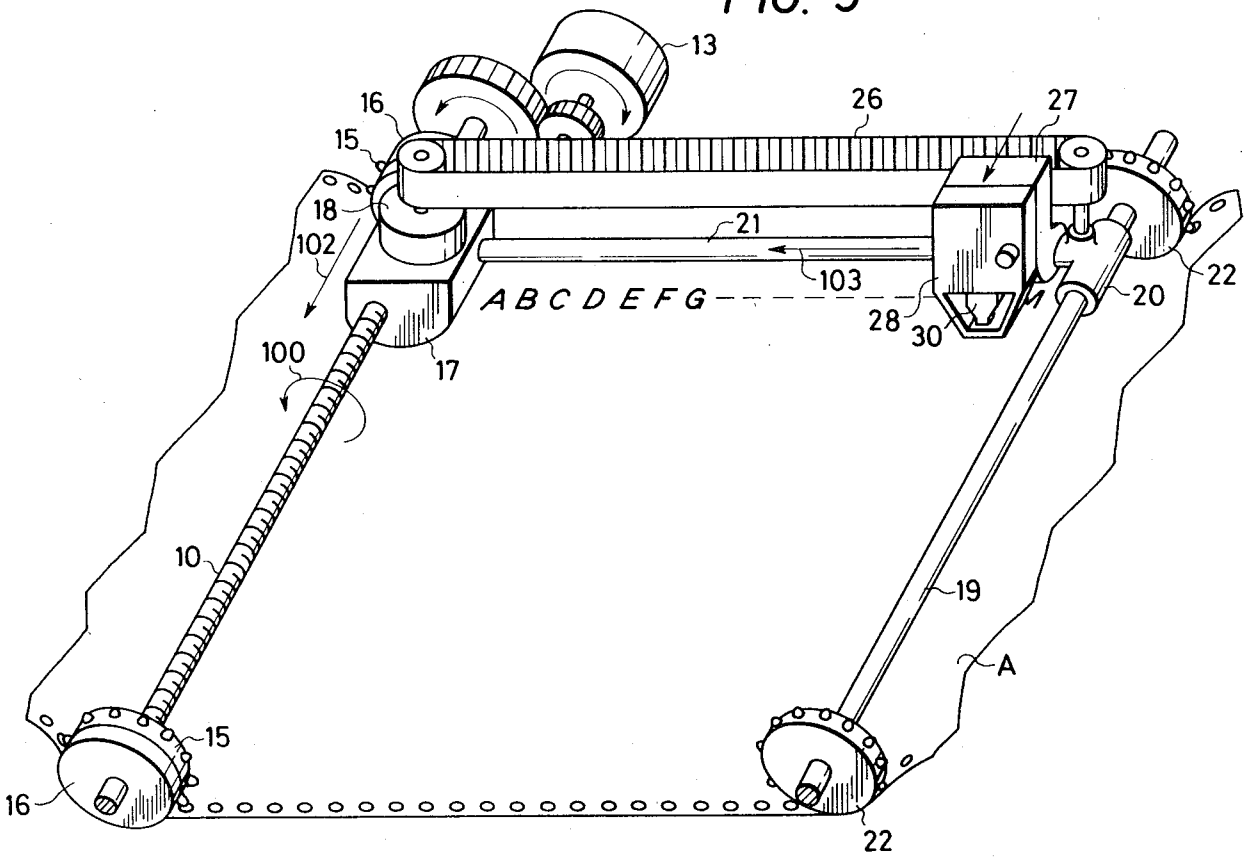

In this condition, when the horizontal feed motor 18 is rotated in the reverse direction (counterwise in FIG. 5) so that the head carriage 27 is moved on the guide shaft 21 along the printing line as indicated by the arrow 103 in FIG. 5, the printing head 30 prints the second line. In this connection, the printer may be so designed that, after the printing head 30 is moved to the leftmost end in FIG. 5 by the motor 18, the printing operation starts.

The above-described printing operation is repeatedly carried out to print characters and the like in a required number of lines on the printing sheet A. When characters and the like are printed to the right end of the last line by the printing head 30, the printing operation of that page is ended; i.e., the vertical feed motor 13 and the horizontal feed motor 18 are stopped.

Figure 4:
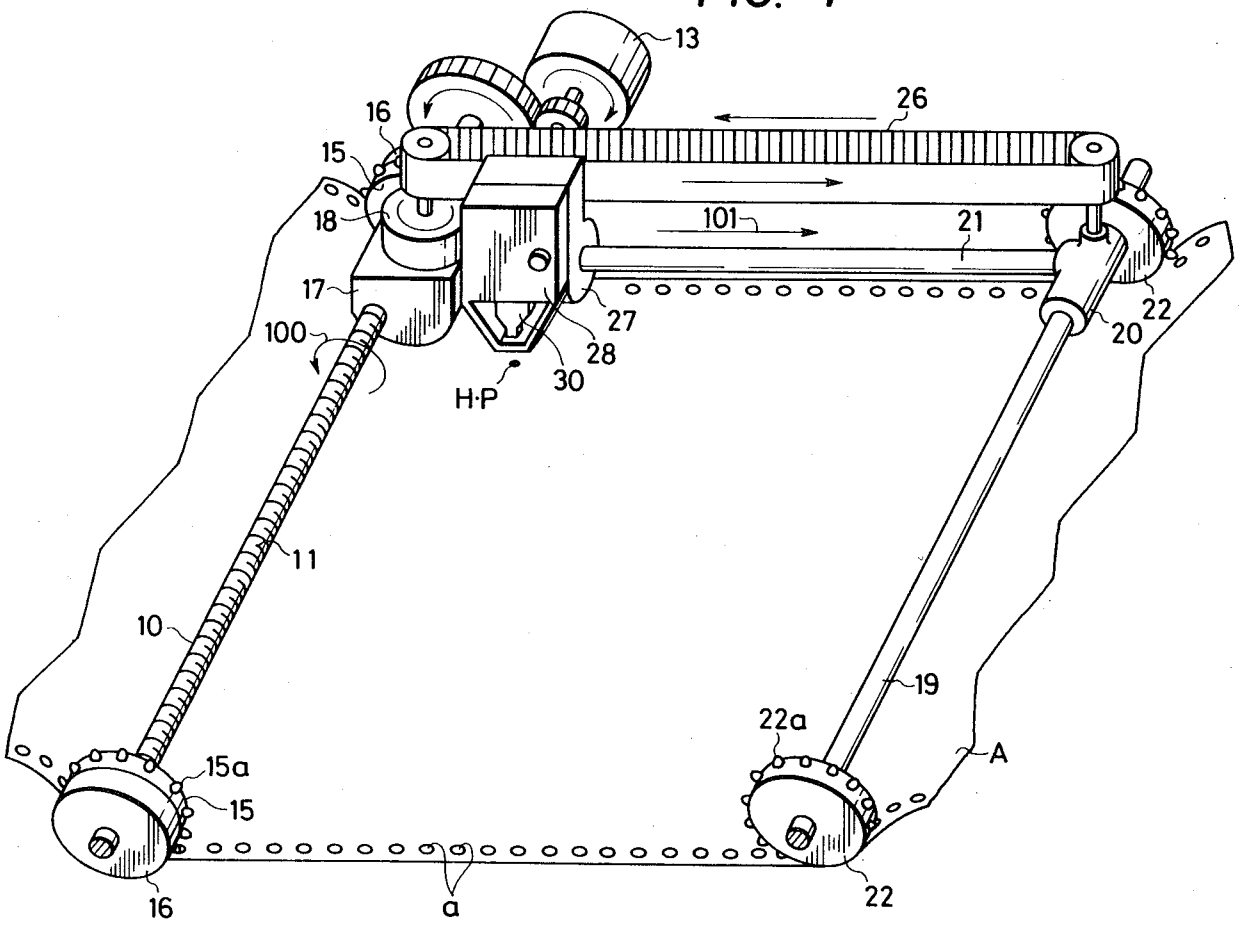
FIGS. 4, 5 and 6 are perspective views illustrating the operation of the printer according to the present invention.
Figure 6:
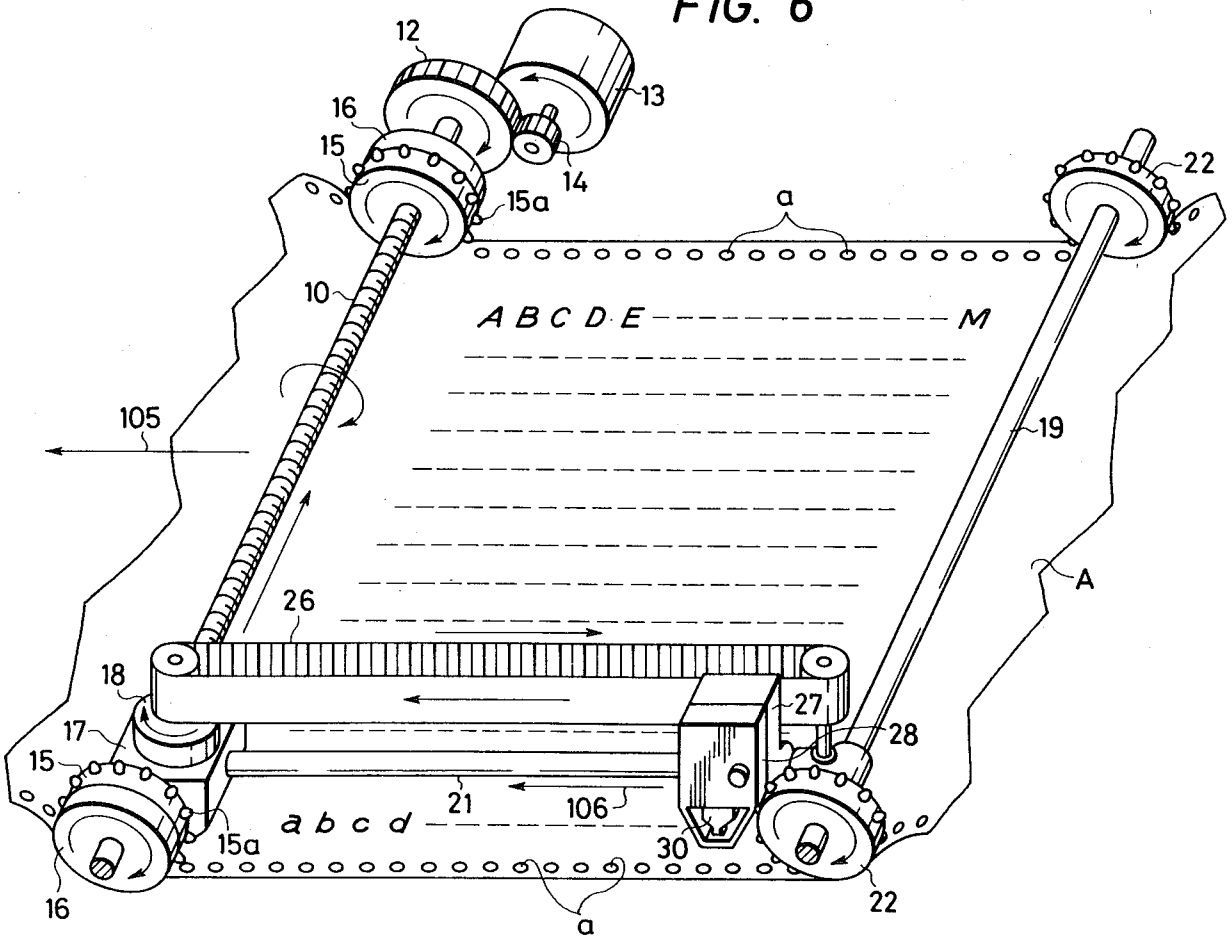

Next, the motors 13 and 18 are rotated in the reverse direction, so that the feeding shaft 10 is turned in the reverse direction as indicated by the arrow 104. As a result, the tractors 15 are engaged with the clutches 16, so that the tractors 15 are rotated by the feeding shaft 10. Since the pins 15*a* of the tractors 15 are engaged with the guide holes a of the printing sheet A, the sheet A is fed horizontally to the left, as indicated by the arrow 105 in FIG. 6, for a distance corresponding to one page as the tractors 15 are rotated as described above. In this operation, the head carriage 27 is moved along the guide shaft 21 horizontally to the left as indicated by the arrow 106 while being moved upwardly to the start position by the reverse rotation of the feeding shaft 10. Thus, the printing head 30 has been returned to the home position HP as shown in FIG. 4, thus being ready for the next printing operation.

The printing operation of one page is accomplished as described above.

Figure 7:
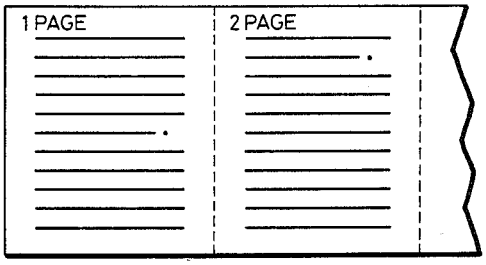
FIG. 7 is an explanatory diagram showing the printing output results of the printer according to the present invention.
Figure 8:
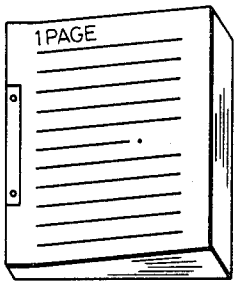
FIG. 8 is a perspective view showing a book which is formed by binding a plurality of pages printed by the printer of the present invention.

FIG. 7 shows printing by the printer according to the invention. As is apparent from FIG. 7, a series of pages are procedural in the horizontal direction, or along the printing line directions, instead of the vertical direction. Accordingly, printing output results over several pages can be readily read when compared with those provided by the conventional printer. The pages can thus be bound into a book as shown in FIG. 8 which, like an ordinary notebook, can be opened horizontally. Accordingly, the printing can be read as in the case of reading an ordinary notebook. Furthermore, in binding the pages printed by the printer of the present invention, unlike those printed by the conventional printer for a word processor, it is unnecessary to separate them by using the perforations or with the cutter. The pages can be bound or filed in such a manner that the printing output results can be readily read.

The invention has been described with reference to the case where the printing head is a serial type head; however, the invention is not limited thereto or thereby. That is, the technical concept of the invention is applicable to a printer with a line head. In this case, the horizontally feeding motor 18, and the belt 26 for transmitting the drive power of the motor to the head carriage 27 can be eliminated, which allows a simpler printer construction.

What is claimed is:

1. A horizontal printing type printer for printing lines on sequence of pages having guide holes extending along top and bottom comprising:

a motor for head feeding and sheet feeding;

a reversible rotatable feeding shaft in a vertical direction perpendicular to the printing line direction and having a cam groove in the cylindrical outer surface thereof;

means for coupling said feeding shaft to said motor;

a pair of sheet feeding tractors engaging guide holes on the top and bottom of said pages respectively and rotatably mounted on said feeding shaft with a predetermined distance therebetween;

a pair of one-way clutches respectively provided on each said sheet feeding tractors, said one-way clutches being engaged with said feeding shaft to rotate together with said feeding shaft in a sheet feeding direction when a printing sheet is fed;

a printing head;

a guide rod spaced apart from and parallel to said feeding shaft; and means for mounting said printing head in relation to said feeding shaft and said guide rod so that said head moved backwards and forwards in said vertical direction according to the direction of rotation of said feeding shaft.

2. A horizontal printing type printer according to claim 1 wherein said mounting means includes:

a guide block slidably mounted on said guide rod;

a guide nut mounted on said feeding shaft, said guide nut engaging said cam groove of said feeding shaft;

a guide shaft having one end connected to said guide nut, said guide shaft extending perpendicularly relative to said feed shaft and said guide rod, the opposite end of said guide shaft being connected to said guide block;

said printing head guide shaft slidably mounted on said guide shaft;

a horizontal feed motor having a motor shaft mounted on said drive nut;

a drive pulley mounted on said motor shaft;

a guide block shaft having a first end connected to said guide block, said guide block shaft being positioned parallel to said motor shaft and perpendicular to said guide rod and said guide shaft, the second end of said guide block shaft having a guide block pulley mounted thereon; and an endless belt laid over said guide block pulley and said drive pulley, said endless belt being attached to said printing head.

* * * * *